US009084999B2

(12) United States Patent
Xiao et al.

(10) Patent No.: US 9,084,999 B2
(45) Date of Patent: Jul. 21, 2015

(54) PROCESSING METHOD AND SYSTEM FOR HIGH-TEMPERATURE SOLID STEEL SLAG

(75) Inventors: Yongli Xiao, Shanghai (CN); Yongqian Li, Shanghai (CN); Yin Liu, Shanghai (CN); Jian Cui, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 342 days.

(21) Appl. No.: 13/818,789

(22) PCT Filed: Aug. 26, 2010

(86) PCT No.: PCT/CN2010/076372
§ 371 (c)(1),
(2), (4) Date: Mar. 14, 2013

(87) PCT Pub. No.: WO2012/024835
PCT Pub. Date: Mar. 1, 2012

(65) Prior Publication Data
US 2013/0206888 A1 Aug. 15, 2013

(51) Int. Cl.
*B02C 17/04* (2006.01)
*C21B 3/08* (2006.01)

(52) U.S. Cl.
CPC .. *B02C 17/04* (2013.01); *C21B 3/08* (2013.01)

(58) Field of Classification Search
CPC ..... C21B 3/06; C21B 3/08; B02C 17/04; B02C 17/183; B02C 19/0056
USPC ..... 241/23, 65, 171, 176, 177, 178
See application file for complete search history.

(56) References Cited

FOREIGN PATENT DOCUMENTS

| | | | |
|---|---|---|---|
| CN | 2734763 | Y | 10/2005 |
| CN | 101760572 | A | 6/2010 |
| CN | 101875984 | A | 11/2010 |
| EP | 2258996 | A1 | 12/2010 |
| JP | 52-017388 | A | 2/1977 |
| JP | 57-148184 | A | 9/1982 |
| JP | 2004-132673 | A | 4/2004 |
| JP | 2004-138276 | A | 5/2004 |
| JP | 2008-100893 | A | 5/2008 |
| JP | 2009-243707 | A | 10/2009 |
| WO | 2009/069794 | A1 | 6/2009 |
| WO | 2009116684 | A1 | 9/2009 |

OTHER PUBLICATIONS

International Search Report mailed on Jun. 2, 2011, for PCT Patent Appln. No. PCT/CN2010/076372, filed on Apr. 26, 2011, 2 pages English, 2 pages Chinese.
Office Action from Korea Appl. No. 10-2013-7004905, dated Apr. 24, 2012 (English translation provided).
Office Action from Japan Appl. No. 2013-525109, dated Apr. 1, 2014 (English Translation provided).
Decision to Grant from Japan Appl. No. 2013-525109, dated Aug. 26, 2014 (English Translation provided).
Office Action from Korea Appl. No. 10-2013-7004905, dated Jan. 26, 2015 (English translation provided).

*Primary Examiner* — Mark Rosenbaum
(74) *Attorney, Agent, or Firm* — Kilpatrick Townsend & Stockton LLP

(57) ABSTRACT

A system for disposing high temperature solid state steel slag includes a working barrel (4), a feeding barrel (9), a liftable hydraulic bracket (12), a supporting device (13) and a transmission device (14). The working barrel (4) axially connects with the feeding barrel (9) in series. The working barrel (4) is provided with cooling and crushing medium (4-1) and spray pipe inside. A method for disposing high temperature solid state steel slag by using said system enables single feeding and multiple disposing.

8 Claims, 4 Drawing Sheets

PROCESSING METHOD AND SYSTEM FOR HIGH-TEMPERATURE SOLID STEEL SLAG

This application is a U.S. National Phase under 35 USC 371 of PCT Application No. PCT/CN2010/076372, filed Aug. 26, 2010, the disclosure of which is incorporated by reference herein.

TECHNICAL FIELD

The disclosure relates to a processing method and a processing system for high-temperature solid steel slag.

BACKGROUND ART

Steel slag is an inevitable byproduct of steelmaking process, and is approximately 10% to 15% of the steel yield, therefore, the rapid and effective processing for steel slag, especially for high-temperature steel slag, directly influences the common run of steelmaking process and the sustainable development of steel companies. Due to the differences among various steel companies' steelmaking processes, the compositions and temperatures of steel slag produced during smelting are not completely identical: some high-temperature steel slag has an excellent fluidity, so that it can be poured out like water; some high-temperature steel slag has a poor fluidity, so that it cannot be easily poured out from a slag ladle (a container for containing and transporting high-temperature steel slag, also called as a slag basin), can only be poured out from the slag ladle by means of mechanical external force or slag ladle inversion.

In order to increase the service life of the slag ladle, and avoid a scouring to the bottom of the slag ladle when pouring in high-temperature steel slag, some steel companies lay some cold slag on the bottom of an empty slag ladle. When high-temperature steel slag is poured in, the portion of cold slag fuses together with the contacted high-temperature steel slag, and forms a large slag shell along with steel slag at the inner wall of the slag ladle. The slag shell is several tons heavy, and is approximately one third of total slag. This portion of slag is either held in the slag ladle, or poured out in a whole from the slag ladle, so that a suitable mechanical crushing is necessary for a subsequent processing, and dust emission is very serious.

Typically, the current processing methods for hot steel slag is a process of hot pouring, wind quenching, shallow tray, hot stuffing, or rolling cylinder, etc.

The process of hot pouring is a relatively original processing method, wherein high-temperature steel slag is poured out onto a designated place, heat of the steel slag dissipates by means of air cooling or slight water spraying, and it is necessary to continuously turn over the steel slag by an excavator or forklift in order to expedite cooling for increasing the processing efficiency; the steel slag after hot pouring cannot be directly utilized, it is necessary for the using by a user to stack and age it for several months, then crush and sort it. The whole processing procedure has a long flow, a large floor area, an execrable operating environment, a serious pollution, and tends to be substituted by other methods.

The process of wind quenching, such as those disclosed in JP24238276 and CN88211276, successfully achieves a rapid granulation processing to liquid steel slag, so that the slag granule after wind quenching is fine and uniform, has a stable performance, and can be utilized directly. Its shortcoming is that the processing subject of this method is limited strictly, i.e., only steel slag having an excellent fluidity can be processed, and steel slag having a higher viscosity and a poor fluidity cannot be processed.

Shallow tray type steel slag processing method increases the producing efficiency on the basis of hot pouring method, but still has shortcomings such as long period, large pollution, high operating fee, aging requirement.

Hot stuffing method for hot steel slag, such as those disclosed in CN02157162.7 and CN200410096981.0, achieves a rapid pulverization processing to steel slag, wherein during about 12 hours, steel slag having a temperature of about 800° C. is pulverized into fine powders in millimeter order by means of its thermal stress and chemical stress, is then sorted for acting as cement clinker directly. The method is relatively simple, can achieve a massive processing for steel slag; however, its shortcomings are also very obvious: in view of safety, this method can only process blocky steel slag having a temperature lower than 800° C., so that hotter steel slag should firstly be cooled outside of the hot stuffing pool, during which, it is necessary to turn over the steel slag repeatedly in order to increase the producing efficiency, causing a serious dust emission and thermal pollution.

Rolling cylinder type steel slag processing method, such as those disclosed in CN99127012.6 and CN200410054165.3, achieves at the first time for the concept of rapid processing high-temperature steel slag within a sealed container, so that high-temperature liquid slag having a temperature of about 1500° C. can be cooled dynamically, continuously and rapidly, and be crushed into granular slag having a temperature lower than 100° C. to be directly used by user, by means of the revolving sealed container. A massive dust-laden steam produced during processing is collectively discharged by a chimney after a purification processing, so that it eliminates the shortcomings, such as diffused steam, raised dust, in a conventional slag processing method. Steel slag having a high viscosity produced by the splashed slag attached to the furnace can be processed by means of a specific slag removal machine. Its shortcoming is that the current rolling cylinder device cannot achieve a cleaning processing to ladle-bottom slag. Because the ladle-bottom slag has a large lumpiness, has not any fluidity, it cannot be directly poured into the current rolling cylinder device, so that a specific slag turning field is needed, onto which the ladle-bottom slag and a portion of high-viscosity slag remained after slag removal are poured, for a conventional cooling and crushing. Therefore, the efficiency is influenced, and dust emission occurs.

BRIEF DESCRIPTION OF THE DISCLOSURE

An object of the disclosure is to provide a processing method for high-temperature solid steel slag, in order to achieve an environment-friendly processing to high-temperature solid steel slag.

Another object of the disclosure is to provide a processing system for high-temperature solid steel slag, in order to achieve an effective processing to high-temperature solid steel slag.

The main conception of the present disclosure is to perform a one-time slag feeding and a gradual processing within a sealed container to high-temperature solid steel slag, wherein the processing device is a dual-cavity serial rolling cylinder with a material feeding barrel and a working barrel, so as to achieve a clean and effective processing to high-temperature solid steel slag.

According to the above-mentioned conception, a processing method for high-temperature solid steel slag comprises: step a, a working barrel is connected axially in series with a material feeding barrel, the material feeding barrel is set to contain adequate high-temperature solid steel slag; step b, the high-temperature solid steel slag is loaded into the material feeding barrel at one time; and step c, the working barrel and the material feeding barrel are rotated simultaneously, so that the high-temperature solid steel slag within the material feeding barrel is transferred axially into the working barrel, the high-temperature solid steel slag gradually transferred from the material feeding barrel is processed in the working barrel, and the processed high-temperature solid steel slag is discharged.

The material feeding barrel being able to contain adequate high-temperature solid steel slag is mounted in the front of the working barrel, so that a one-time material feeding operation for various slag ladles can be achieved.

According to the above-mentioned conception, a processing system for high-temperature solid steel slag comprises: a working barrel, in which cooling and crushing medium for high-temperature steel slag, a spray pipe of a spray cooling system are disposed; a material feeding barrel, which is disposed in front of the working barrel and connected rigidly and axially in series with the working barrel, wherein the axis of the material feeding barrel aligns with the axis of the working barrel, a material feeding port is located on a side surface of the material feeding barrel, a seal door mating with the material feeding port is disposed at the material feeding port, and the seal door can be opened/closed and locked; an ascending/descending hydraulic bearing seat, which is disposed beneath the material feeding barrel; a supporting device, which supports the working barrel and the material feeding barrel, wherein the working barrel and the material feeding barrel can rotate on the supporting device; and a driving device for driving the working barrel and the material feeding barrel to rotate on the supporting device.

When ready for feeding material, the material feeding port of the material feeding barrel is rotated to a designated position directly upwards by the driving device, the hydraulic bearing device beneath the material feeding barrel is turned on, so that it securely bears the material feeding barrel; the material feeding port is opened, and then the material feeding operation starts, wherein the one-time slag feeding operation is achieved by pouring the high-temperature solid steel slag into the material feeding barrel via the material feeding hopper for one time, through titling the slag ladle; after the one-time slag feeding is finished, the material feeding port of the material feeding barrel is closed, the driving device is turned on, the high-temperature solid steel slag within the material feeding barrel moves downwards gradually as the barrel rotates, orderly into the working barrel; blocky high-temperature solid steel slag is continuously cooled and crushed by the cooling and crushing medium within the working barrel and finished slag having a certain granularity is transported out of the working barrel by the discharging device.

In a preferable embodiment, the axis of the material feeding barrel and the working barrel has an inclination angle with respect to the horizontal plane, which is 0~20°.

In a preferable embodiment, a movable trolley is disposed above the material feeding barrel, a seal door is disposed at the material feeding port, the material feeding is via a material feeding hopper, the movable trolley has two stations, i.e., a station for seal door and a station for material feeding hopper; when the material feeding hopper is in the material feeding operation, the seal door is removed by the movable trolley; when the seal door is in a closed and locked state, the material feeding hopper is in an offline station by the movable trolley.

In a preferable embodiment, an open/close locking device is mounted on the seal door, and comprises a locking block secured on the seal door and a corresponding locking indenter on the material feeding barrel, and the pressing and opening of the locking indenter is achieved by a robot on the movable trolley.

In a preferable embodiment, an open/close locking device is mounted on the seal door, and comprises a driving motor, a worm-gear and a crank device, wherein the crank device is secured to the back surface of the seal door at one end, is secured to the output shaft of the worm-gear at the other end, and performs an open/close operation as the worm-gear rotates.

In a preferable embodiment, an open/close locking device is mounted on the seal door, and comprises a rotating joint, a hydraulic cylinder and a hydraulic station, wherein the rotating joint is connected to the hydraulic station at one end, is connected to one end of the hydraulic cylinder at the other end, is mounted on the front end surface of the material feeding barrel, is at the same axis as the material feeding barrel, and the other end of the hydraulic cylinder is connected to the seal door.

In a preferable embodiment, the seal door is a flat plate, is articulated to the front end surface of the material feeding barrel at one end, and is connected to the hydraulic cylinder or worm-gear device of the open/close locking device at the other end.

In a preferable embodiment, the seal door is a curved plate and disposed at the material feeding port, the curvature of the seal door is equal to the curvature of the side surface of the material feeding barrel, and the seal door is connected to the hydraulic cylinder or worm-gear device of the open/close locking device.

In a preferable embodiment, the seal door is a curved plate and disposed at the material feeding port, the curvature of the seal door is equal to the curvature of the side surface of the material feeding barrel, the engaging surface of the seal door with the material feeding port is conical, i.e., larger at outside and smaller at inside, so as to facilitate the mating and sealing of both; the seal door can be lifted and dropped easily by the robot on the movable trolley.

The above-mentioned steel slag processing method adopts a method of "one-time slag feeding, gradual processing", and changes the existed method of "processing while slag feeding", so that it not only increases the operating rate of the traveling crane, but also eliminates the slag ladle titling device and the slag removal device required by high-viscosity slag processing. It not only reduces the massive invest, but also highly increases the producing efficiency, so that it can rapidly process high-viscosity slag, especially blocky high-temperature steel slag such as ladle-bottom slag.

The above-mentioned steel slag processing device adopts a dual-cavity serial structure with a material feeding barrel and a working barrel, changes the existed single-process-cavity processing cylinder, adds a material feeding/stocking cavity at one side of the process cavity, and smartly achieves an axial feeding and flowing of slag material within the barrel by means of a spiral motion produced by an inclination angle and a cylinder rotation. It not only solves the technical bottle-neck of ladle-bottom slag feeding, but also achieves a processing method of "integral material feeding, gradual processing".

The above-mentioned steel slag processing method and device has a complete sealed operation during processing high-temperature solid steel slag, and in the condition of adding a steam collecting system, it not only can cancel the chimney, reduce the massive initial cost, but also can reduce the dust emission to nearly zero, the steam can also be retrieved by condensation; at the same time, this processing method totally eliminates the influence and limitation of hot steel slag fluidity to the processing method, so that it is possible to "firstly perform a waste heat recovery and then perform a crushing process via rolling cylinder to steel slag", and it further increases the deepness and level of utilizing steel slag resources.

BRIEF DESCRIPTION OF THE DRAWINGS

The particular features and performances of the present disclosure are further given by the following embodiments and figures.

Figure 1:
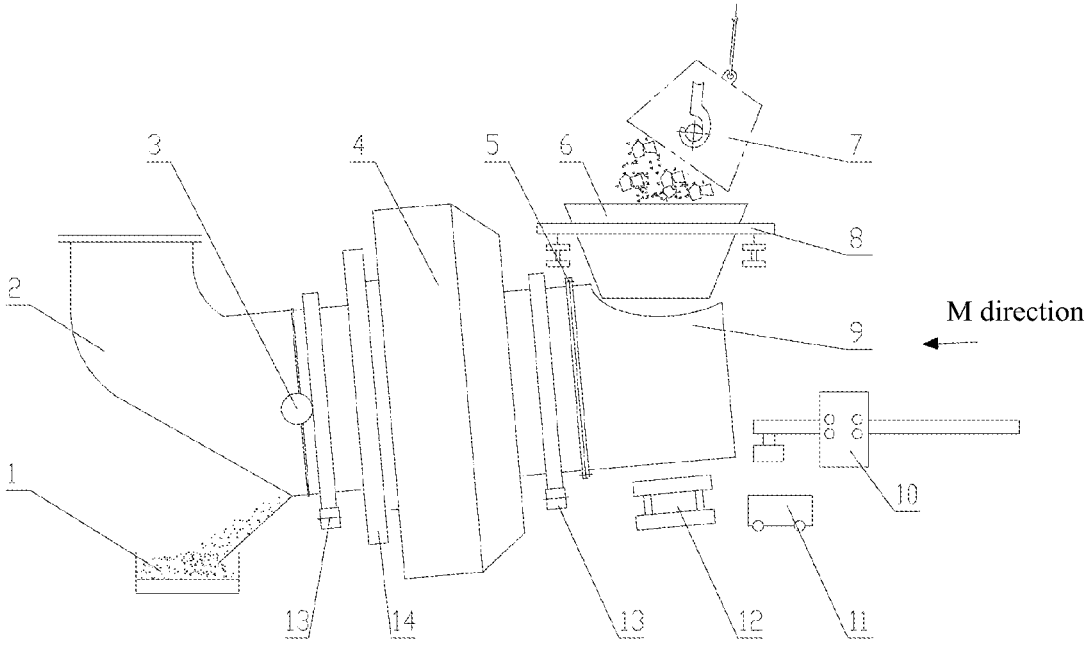
FIG. 1 is a structural diagrammatic view of an embodiment of a processing device for high-temperature solid steel slag.

In the figures: 1 material discharging system: 1-1 finished slag transporting device, 1-2 finished slag, 1-3 material discharging chute; 2 gas discharging mechanism; 3 stopping device; 4 working barrel: 4-1 cooling and crushing medium (steel balls), 4-2 plate; 5 connecting flange; 6 material feeding hopper; 7 slag ladle; 8 movable trolley and rail; 9 material feeding barrel: 9-1 material feeding port; 10 waste steel cleaning device; 11 waste steel stocking trolley; 12 hydraulic bearing device; 13 supporting device: 13-1 supporting ring, 13-2 supporting wheel; 14 driving device: 14-1 large ring gear, 14-2 small shaft gear, 14-3 decelerator, 14-4 motor; 15 seal door mounting-locking robot; 16 seal door; 17 locking device: 17-1 connecting rod, 17-2 hydraulic station, 17-3 hydraulic cylinder, 17-4 rotating joint, 17-5 motor for opening/closing seal door, 17-6 worm-gear device, 17-7 shaft sleeve, 17-8 crank device, 17-9 supply socket; 18 steel slag to be processed; 19 spay cooling system.

BEST MODE FOR CARRYING OUT THE DISCLOSURE

Hereinafter, the present disclosure will be further explained in connection with figures and particular embodiments. The below-mentioned working barrel and its mating supporting, driving devices can be implemented and modified according to the slag processing device in rolling cylinder method disclosed in WO2006/024231.

FIGS. 1-8 show a processing method for high-temperature solid steel slag, wherein a material feeding barrel 9, which can contain adequate high-temperature solid steel slag, is mounted in the front of a working barrel 4, a material feeding port 9-1 and an automatic open/close seal door 16 are located on a side surface of the material feeding barrel 9, the material feeding barrel 9 is coaxially and rigidly secured to the working barrel 4 by a flange 5, and the axis has an upward inclination angle A with respect to the horizontal plane; angle A is 0~20°.

Cooling and crushing medium 4-1, i.e., steel balls, is disposed within the working barrel 4, for rapidly cooling and crushing blocky high-temperature steel slag; cooling water ejected from a spray cooling system 19 controllably achieves a cooling and immersion to the crushed steel slag so as to rapidly stabilize the steel slag and make the steel slag have a normal temperature, and achieves a heat-exchange cooling to the steel balls 4-1; the working barrel 4 and the material feeding barrel 9 are supported by a supporting device 13 and a stopping device 3, wherein the supporting device 13 is composed of supporting rings 13-1 and supporting wheel devices 13-2, two supporting rings 13-1 are secured to the front and rear portions of the working barrel 4, respectively; the driving device 14 is composed of a large ring gear 14-1, a small shaft gear 14-2, a decelerator 14-3, and a motor 14-4, wherein the large ring gear 14-1 is secured to the working barrel 4. Through driving function of the driving device 14, the working barrel 4 and the material feeding barrel 9 can rotate in a given direction and speed. The rotating components stop at a certain orientation, i.e., each time they stop, the material feeding port of the material feeding barrel 9 and the seal door 16 are located directly upwards, in order to facilitate opening and closing of the seal door 16 and material feeding operation.

When feeding, a hydraulic bearing device 12 beneath the material feeding barrel is turned on, and securely bears the material feeding barrel 9; by means of a remotely driven hydraulic system or a manual intervention (i.e., the power on and off of a worm-gear system is achieved by a person at a static state), a seal door mounting-locking robot 15 above a movable trolley 8 or the worm-gear system is driven to open the material feeding door 16, a material feeding hopper 6 is moved directly above the material feeding port, a slag ladle 7 is moved directly above the material feeding hopper 6 by traction of a traveling crane, the slag ladle 7 is turned over, the high-viscosity slag or ladle-bottom slag in the ladle is poured into the material feeding barrel 9 at one time, then the material feeding hopper 6 and the hydraulic bearing device therebeneath are removed, the material feeding door 16 is closed and locked by the hydraulic system or worm-gear system (when the worm-gear system is used, the power plug should be pulled out).

When material feeding is finished, the driving device 14 is turned on, the solid slag within the material feeding barrel 9 moves downwards gradually as the barrel 9 rotates, in the form of spiral feeding, enters into the working barrel 4 orderly; at the same time, the spray system 19 starts a spray cooling operation, blocky solid steel slag is continuously cooled and crushed by rolling steel balls 4-1 within the working barrel 4, as the working barrel 4 rotates, and finished slag having a certain granularity is transported out of the working barrel 4 by a discharging device 1.

The dust-laden waste gas produced during processing is collected by a gas discharging mechanism 2, and is collectively discharged after a purification processing; the waste water is used circularly.

FIGS. 1-8 further show a processing system for high-temperature solid steel slag comprising a material feeding barrel 9 and a working barrel 4. Cooling and crushing medium 4-1 for high-temperature steel slag, i.e., steel balls, and a spray cooling system 19, are disposed within the working barrel 4; the axis of the working barrel 4 has a inclination angle A with respect to the horizontal plane, the working barrel 4 is supported by supporting wheel devices 13-2 and supporting rings 13-1, and the axial force produced during rotating of the working barrel 4 and the material feeding barrel 9 is balanced by a stopping device 3; a driving device 14 is composed of a large ring gear 14-1, a small shaft gear 14-2, a decelerator 14-3, and a motor 14-4, wherein the large ring gear 14-1 is secured to the working barrel 4, through driving function of the driving device 14, the working barrel 4 and the material feeding barrel 9 can rotate in a given direction and speed. A gas discharging mechanism 2 and a material discharging mechanism 1 are disposed at the rear end of the working barrel 4, wherein the gas discharging mechanism 2 collects the waste gas and dust produced during processing, for purifying and discharging in a subsequent step; the material discharging mechanism 1 directs the finished steel slag 1-2 after processing out of the working barrel 4, and transports it to an outside temporary storage yard or storage bunker for finished slag.

The material feeding barrel 9 is disposed in the front of the working barrel 4, a material feeding port and its mating seal door 16 are located on a side surface of the material feeding barrel 9, the opening and closing of the seal door 16 is achieved by an open/close locking device 17 and its mating robot 15, the action of the open/close locking device 17 can be achieved by a hydraulic system or a worm-gear system. The hydraulic system comprises a connecting rod 17-1, a hydraulic station 17-2, a hydraulic barrel 17-3, a rotating joint 17-4, and the like; the worm-gear system comprises a motor 17-5 for opening/closing the seal door, a worm-gear device 17-6, a shaft sleeve 17-7, a crank 17-8, and a supply socket 17-9, the worm-gear system is secured to the material feeding barrel.

A material feeding port is opened at the front end of the material feeding barrel 9, the rear end of the material feeding barrel 9 is secured to the front end of the working barrel 4, the axis of the material feeding barrel 9 aligns with the axis of the working barrel 4, i.e., the axis of the material feeding barrel 9 and the working barrel 4 has a inclination angle A with respect to the horizontal plane. In an embodiment, the inclination angle A of the axis of the material feeding barrel 9 and the working barrel 4 with respect to the horizontal plane is between 0° to 20°. The spray cooling system 19 provides cooling water, and achieves a spray cooling to steel slag and its corresponding devices, so as to rapidly stabilize the steel slag and make the steel slag have a normal temperature.

Figure 2:
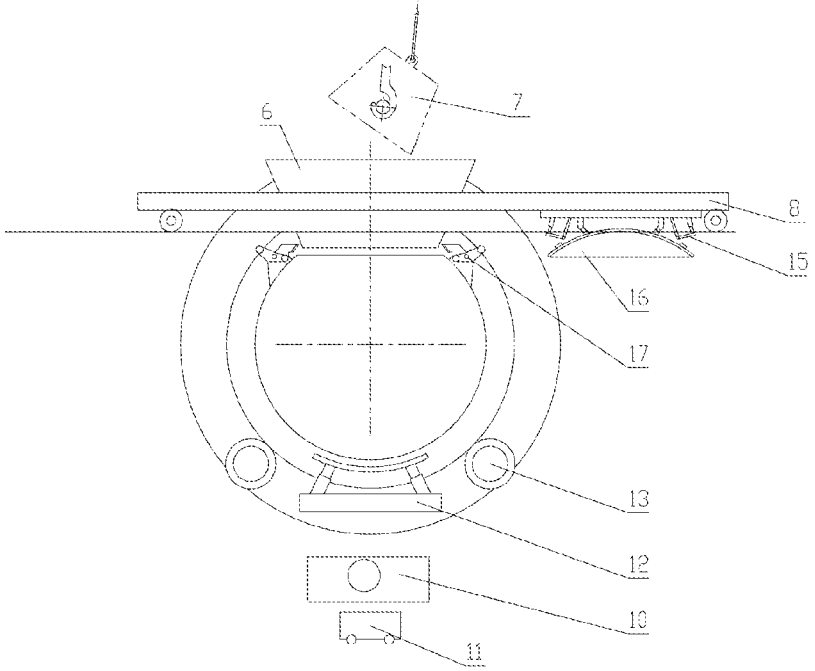
FIG. 2 is a view along direction M of FIG. 1.

With reference to the embodiment of FIGS. 1-2, a material feeding port is disposed on a side surface of the material feeding barrel 9, the seal door is a curved plate type seal door 16, and the curvature of the curved plate type seal door 16 is equal to the curvature of the side surface of the material feeding barrel 9 at the front end; the curved plate type seal door 16 is mounted by the robot 15 on a movable trolley, and is locked and opened by the robot 15 and the locking mechanism 17.

Figure 3:
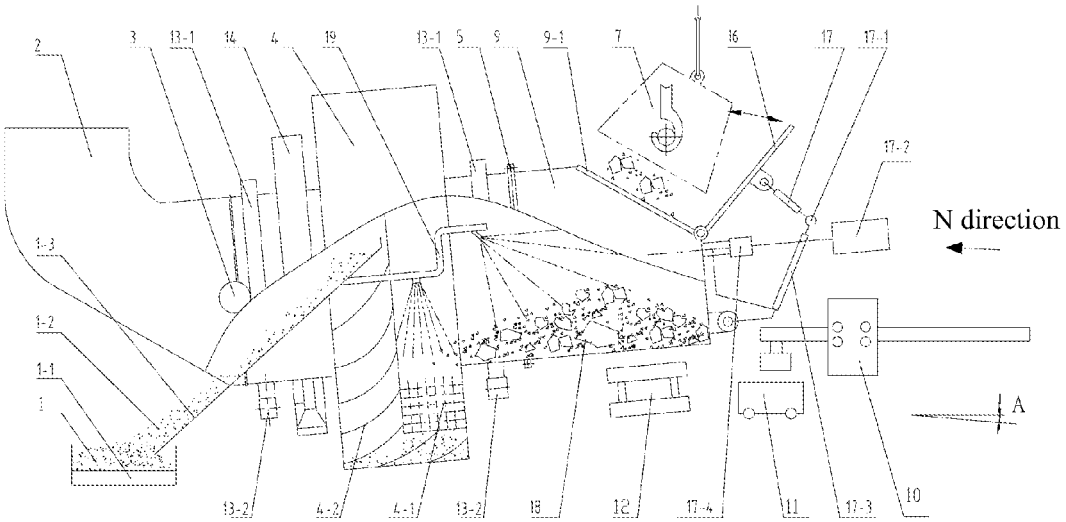
FIG. 3 is a structural diagrammatic view of another embodiment of a processing device for high-temperature solid steel slag.
Figure 4:
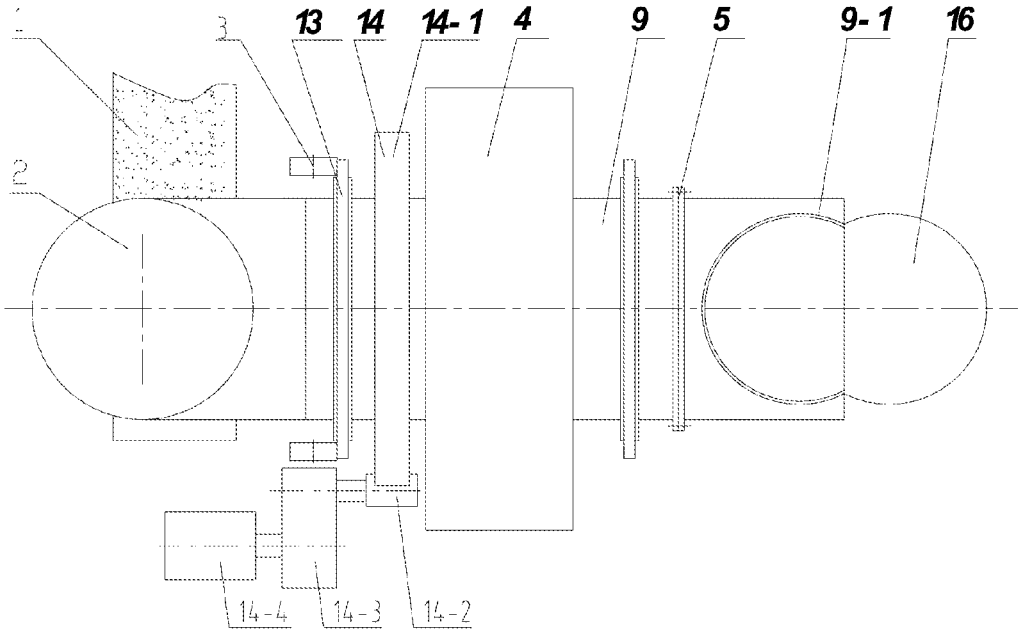
FIG. 4 is a top view of FIG. 3.

With reference to the embodiment of FIGS. 3-4, a material feeding port is disposed on a side surface of the material feeding barrel 9, the seal door is a flat plate type seal door 16, the flat plate type seal door 16 is articulated to the front end surface of the material feeding barrel 9 at one end, and is connected to the hydraulic cylinder 17-3 of the open/close locking device 17 at the other end.

Figure 5:
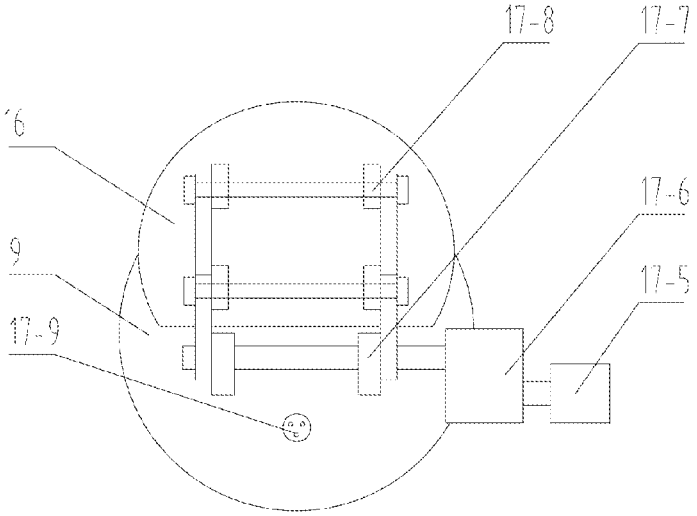
FIG. 5 is a view along direction N of FIG. 1, i.e., a diagrammatic view of a method for locking a seal door of another embodiment.

With reference to the embodiment of FIG. 5, a material feeding port is disposed on a side surface of the material feeding barrel 9, the seal door 16 is a flat plate type or curved plate type, the back surface of the seal door 16 is connected to the worm-gear system of the open/close locking device 17.

Figure 6:
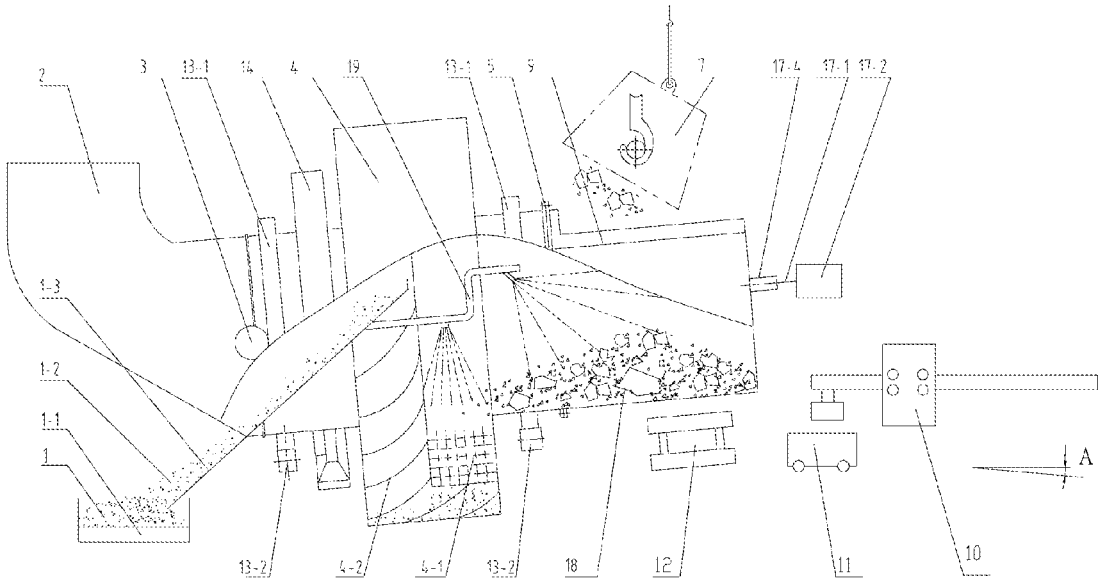
FIG. 6 is a structural diagrammatic view of another embodiment of a processing device for high-temperature solid steel slag.
Figure 7:
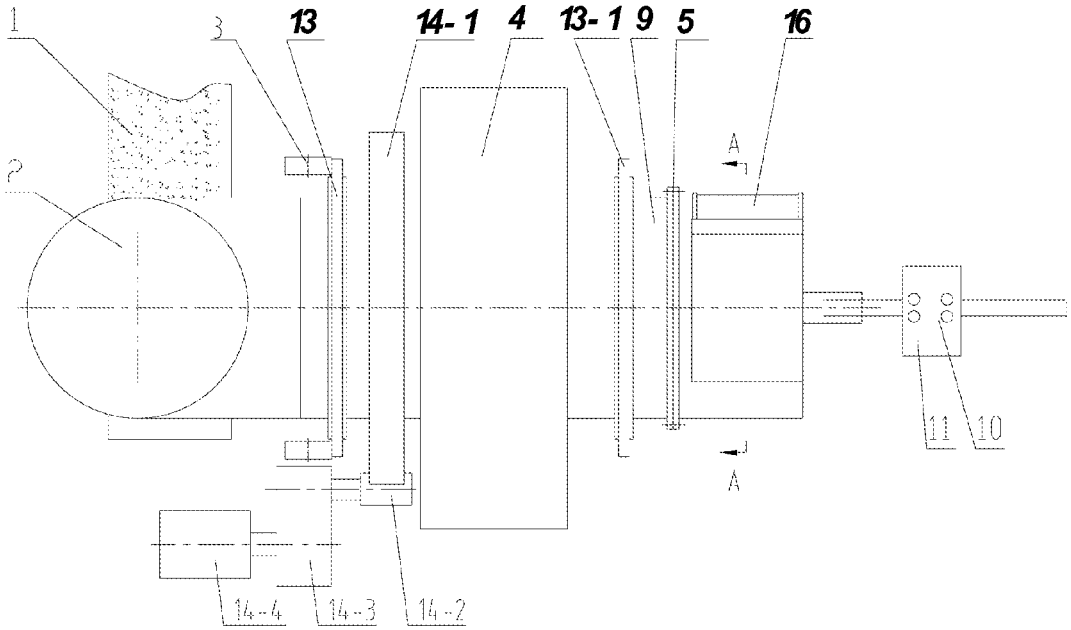
FIG. 7 is a top view of FIG. 6.
Figure 8:
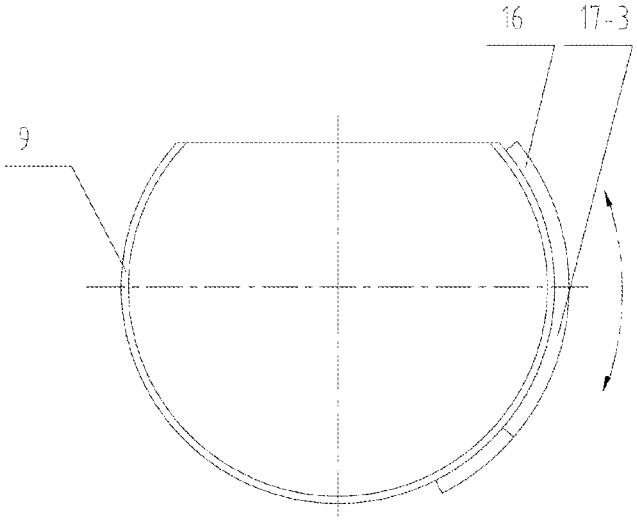
FIG. 8 is a sectional view along direction A-A of FIG. 7.

With reference to the embodiment of FIGS. 6-8, a material feeding port and a curved plate type seal door 16 are disposed on a side surface of the material feeding barrel 9, and the curvature of the curved plate type seal door 16 is equal to the curvature of the side surface of the material feeding barrel 9 at the front end; the curved plate type seal door is connected to the hydraulic cylinder 17-3 of the open/close locking device 17 at two ends.

With reference to FIGS. 1-8 simultaneously, the processing device for high-temperature solid steel slag as shown operates as follows:

When slag is ready to poured in, the driving device 14 is turned on by a operator, so that the material feeding barrel 9 and the working barrel 4 start rotating, and when the material feeding port on the material feeding barrel 9 is located directly upwards, the driving device 14 is turned off, so that the material feeding barrel 9 stops rotating.

The hydraulic bearing device 12 beneath the material feeding barrel is turned on, and securely bears the material feeding barrel 9, the open/close locking device 17 for seal door via a hydraulic system is turned on by a remote operation, or the open/close locking device 17 for seal door via a worm-gear system is turned on by switching on the power supply (the equipment is at a static state), the seal door 16 above the material feeding port is opened, at the same time the material feeding hopper 6 is moved directly to the position above the material feeding port via a movable trolley 8 and is locked, the material feeding hopper 6 is not necessary for transition if the material feeding port is relatively proper, as shown in FIGS. 3 and 6; the slag ladle 7 is moved directly above the material feeding hopper 6 or the material feeding port by traction of a traveling crane, the slag ladle 7 is turned over slowly, the high-viscosity slag or blocky ladle-bottom slag 18 in the slag ladle 7 is poured into the material feeding barrel 9 at one time; the material feeding hopper 6 is removed, the seal door 16 is moved to the location of the material feeding port, and the flat plate type or curved plate type seal door 16 is closed and locked by the locking mechanism 17, when a worm-gear system is used, the power plug should be pulled out, so that the one-time material feeding of the material feeding barrel 9 is completed.

When slag feeding is finished, the hydraulic bearing device 12 beneath the material feeding barrel is removed away, the driving device 14 is turned on, so that the material feeding barrel 9 and the working barrel 4 rotate synchronously, and the rotating speed increases from slow to fast, gradually achieving a set value. Under the combined action of the gravity component force in the axial direction of the material feeding barrel 9 and the rotating force of the material feeding barrel 9, the blocky high-temperature steel slag 18 within the material feeding barrel 9 moves downwards gradually as the material feeding barrel 9 rotates, in the form of spiral feeding, and enters into the working barrel 4 orderly. The steel slag 18 is rapidly cooled and crushed by steel balls 4-1 within the working barrel 4 as the working barrel 4 rotates, cooling water ejected from a spray cooling system 19 controllably achieves a heat-exchange cooling to the steel balls 4-1, and achieves a secondary cooling and immersion to steel slag cooled and crushed by steel balls 4-1, so that the temperature of the finished steel slag 1-2 having a certain granularity drops to less than 100° C., the finished steel slag 1-2 is transported to a finished slag transporting device 1-1 via a slag discharging plate 4-2 and a material discharging chute 1-3, for a subsequent sorting step.

The lumpy cold steel occluded in the high-temperature solid steel slag 18 will be accumulated within the working barrel 4 after processed by the working barrel 4, and should be cleaned up when being accumulated to a certain amount to clean up the lumpy cold steel, the seal door 16 is firstly removed or opened, the material feeding port of the material feeding barrel 9 is rotated to a vertical underpart by controlling the driving mechanism 14, the lumpy cold steel is cleaned up from the working barrel 4 by operation of a robot 10 for cleaning up cold steel, and is temporarily stored in a cold steel bin/trolley 11, for a subsequent processing.

The residual cooling water during processing is collected and deposited, and then is used circularly; the dust-laden waste steam produced during processing is collected and dedusted via mist spray by a gas discharging mechanism 2, and then is discharged after reaching the standards.

The invention claimed is:

1. A processing method for high-temperature solid steel slag, comprising:

step a, coaxially and rigidly connecting a working barrel axially in series with a material feeding barrel, and arranging the axis of the material feeding barrel and the working barrel at an inclination angle with respect to the horizontal plane, wherein the material feeding barrel is set to contain adequate high-temperature solid steel slag, providing a material feeding port and seal door on a side surface of the material feeding barrel where the seal door could be open or closed, disposing steel balls as cooling and crushing medium and disposing a spray cooling system in the working barrel;

step b, using a hydraulic bearing device to support the material feeding barrel, opening the seal door, moving a material feeding hopper to a position directly above the material feeding port, moving a slag ladle to a position directly above the material feeding hopper by traction of a traveling crane, turning over the slag ladle to pour high-viscosity slag or ladle-bottom slag in the ladle into the material feeding barrel at one time, closing the seal door and removing the hydraulic bearing device; and step c, rotating the working barrel and the material feeding barrel simultaneously, so that under the combined action of the gravity component force in the axial direction of the material feeding barrel and the rotating force of the material feeding barrel, the high-temperature solid steel slag within the material feeding barrel moves downwards gradually as the material feeding barrel rotates, in the form of spiral feeding, and enters into the working barrel orderly, to continuously cool and crush blocky high-temperature solid steel slag by the cooling and crushing medium within the working barrel, using cooling water ejected from the spray cooling system controllably to a cool and immerge crushed steel slag so as to rapidly stabilize steel slag and make steel slag have a normal temperature, and cool steel balls; and the high-temperature solid steel slag gradually transferred from the material feeding barrel is processed in the working barrel, and discharging the processed high-temperature solid steel slag.

2. The processing method according to claim 1, wherein, in the step c, the processing procedure for high-temperature solid steel slag is a completely sealed operation, the steam produced in the sealed operation can be collected by a steam collecting system.

3. A processing system for high-temperature solid steel slag, comprising:

a working barrel, in which steel balls as cooling and crushing medium for high-temperature steel slag, a spray pipe of a spray cooling system are disposed, the cooling and crushing medium being for rapidly cooling and crushing blocky high-temperature steel slag, cooling water ejected from the spray cooling system controllably be for achieving a cooling and immersion to crushed steel slag so as to rapidly stabilize steel slag and make steel slag have a normal temperature, and achieving a heat-exchange cooling to steel balls;

a material feeding barrel, having functions of both material feeding cavity and stocking cavity, disposed in the front of the working barrel and connected rigidly and axially in series with the working barrel, wherein the axis of the material feeding barrel aligns with the axis of the working barrel, a material feeding port is located on a side surface of the material feeding barrel, a seal door mating with the material feeding port is disposed at the material feeding port, and the seal door can be opened/closed and locked;

a material feeding hopper above the material feeding port, which is disposed on a movable trolley above the material feeding barrel, and moves between a material feeding station and a stand-by station according to the requirements of material feeding and processing operation, and is assisted a ladle to pour high-viscosity slag or ladle-bottom slag in the ladle into the material feeding barrel at one time;

a supporting device, which supports the working barrel and the material feeding barrel, wherein the working barrel and the material feeding barrel can rotate on the supporting device; and an ascending/descending hydraulic bearing seat, which is located directly beneath the material feeding port, for cushioning the shock to the barrel when feeding;

a driving device for driving the working barrel and the material feeding barrel to rotate on the supporting device;

wherein, the axis of the material feeding barrel and the working barrel has an inclination angle with respect to the horizontal plane, and under the combined action of the gravity component force in the axial direction of the material feeding barrel and the rotating force of the material feeding barrel, the high-temperature solid steel slag within the material feeding barrel moves downwards gradually as the material feeding barrel rotates, in the form of spiral feeding, and enters into the working barrel orderly.

4. The processing system for high-temperature solid steel slag according to claim 3, wherein, the supporting device comprises supporting wheels, supporting rings and a stopping device, wherein a plurality of supporting rings wrap around the barrels, the supporting wheels are disposed beneath the supporting rings and mate with the supporting rings, the stopping device functions to balance the axial force produced by the material feeding barrel and the working barrel.

5. The processing system for high-temperature solid steel slag according to claim 3, wherein, the system also comprises a cleaning device for cold steel, which is disposed at the front end of the material feeding barrel to clean up the waste steel through the material feeding port.

6. The processing system for high-temperature solid steel slag according to claim 3, wherein, the engaging portion of the seal door with the material feeding port is conical, i.e., larger at outside and smaller at inside, and an open/close locking device mating with the material feeding barrel is mounted on the seal door.

7. The processing system for high-temperature solid steel slag according to claim 3, wherein, the seal door is a flat plate, is articulated to the front end surface of the material feeding barrel at one end, and is connected to the open/close locking device at the other end.

8. The processing system for high-temperature solid steel slag according to claim 3, wherein, the seal door at the material feeding port is a curved plate type structure, and the curvature of the seal door is equal to the curvature of the side surface of the material feeding barrel, so that the inner cavity of the material feeding barrel is a complete circular cylinder when the seal door covers the material feeding port and is locked.

* * * * *